United States Patent [19]

Brastad et al.

[11] 4,230,924

[45] Oct. 28, 1980

[54] METHOD AND MATERIAL FOR PREPACKAGING FOOD TO ACHIEVE MICROWAVE BROWNING

[75] Inventors: William A. Brastad, Minneapolis; Nelson J. Beall, St. Michael, both of Minn.

[73] Assignee: General Mills, Inc., Minneapolis, Minn.

[21] Appl. No.: 950,759

[22] Filed: Oct. 12, 1978

Related U.S. Application Data

[63] Continuation-in-part of Ser. No. 910,262, May 30, 1978, abandoned.

[51] Int. Cl.[3] ..... H05B 6/80; B65D 81/34

[52] U.S. Cl. ..... 219/10.55 E; 219/10.55 F; 229/3.5 MF; 426/107; 426/234

[58] Field of Search ..... 219/10.55 E, 10.55 M, 219/10.55 F, 10.55 R; 426/107, 234; 229/3.5 MF, 87 F

[56] References Cited

U.S. PATENT DOCUMENTS

| | | | |
|---|---|---|---|
| 3,490,580 | 1/1970 | Brumfield et al. | 219/10.55 E |
| 3,783,220 | 1/1974 | Tanizaki | 219/10.55 E |
| 3,922,452 | 11/1975 | Forker, Jr. | 219/10.55 E X |
| 3,946,188 | 3/1976 | Derby | 219/10.55 E |
| 4,003,368 | 1/1977 | Maxel | 219/10.55 E X |
| 4,144,438 | 3/1979 | Gelman et al. | 219/10.55 E |

*Primary Examiner*—Arthur T. Grimley

*Attorney, Agent, or Firm*—Gene O. Enockson; L. MeRoy Lillehaugen

[57] ABSTRACT

The food package includes a flexible wrapping sheet of dielectric material, such as polyester or paperboard, capable of conforming to at least a portion of the article of food's shape. The dielectric wrapping sheet has a flexible metallic coating thereon, such as aluminum, in the form of a relatively thin film or relatively thick foil, the coating being subdivided into a number of individual metallic islands or pads separated by criss-crossing non-metallic gaps provided by exposed dielectric strips on the wrapping sheet. When the food package is placed in a microwave oven, some of the microwave energy passes through the wrapping sheet so as to dielectrically heat the food item, but a lesser amount of the microwave energy is converted into thermal energy by the metallic coating so as to brown or crispen that portion of the food adjacent thereto. Various degrees of microwave transparency can be incorporated into the metallic coating so that a desired or preferred amount of browning is realized by the time that the particular item of packaged food is fully heated or cooked.

21 Claims, 8 Drawing Figures

METHOD AND MATERIAL FOR PREPACKAGING FOOD TO ACHIEVE MICROWAVE BROWNING

BACKGROUND OF THE INVENTION

This application is a continuation-in-part of our earlier filed application Ser. No. 910,262, filed May 30, 1978, now abandoned.

FIELD OF THE INVENTION

This invention relates generally to the prepackaging of articles of food to be heated in a microwave oven, and pertains more particularly to a food package which will produce a desired degree of microwave browning to the food contained therein.

DESCRIPTION OF THE PRIOR ART

The heating of food articles with microwave energy has now become commonplace. It is widely recognized, however, that the molecular friction resulting from the high frequency oscillation fails to impart the proper amount of so-called browning and/or crispness to foods normally expected to possess such a quality. Consequently, foods of the foregoing type, after being heated or cooked in a microwave oven, do not possess the requisite degree of eye appeal and taste appeal that one normally expects.

Various attempts have been made to correct for the inherent lack of browning (or crispening) when employing microwave heating. Such attempts have included the physical modification of the microwave oven, namely, the adding of electric broiling elements that produce the needed shorter wavelength energy for obtaining the browning of the food. Also, means have been incorporated into the microwave oven which convert the high frequency energy by resistive losses into heat; here again, this requires the adding of elements to the microwave oven itself. At any rate, various lossy devices have been incorporated into microwave ovens in order to achieve the requisite or desired surface coloration of food.

Additionally, edible coatings have been added to the food itself in order to induce browning and crispening. Still further, various utensils or dishes have been devised which will promote browning.

Various shortcomings, however, have attended the different prior art attempts known to us. Some have been costly, particularly those requiring modification or the adding of components to a microwave oven. Utensils or dishes can be made to add heat to the food surface for browning but cannot be wrapped around the product. Furthermore, such utensils and dishes are costly and require preheating because of their large thermal mass.

SUMMARY OF THE INVENTION

One object of our invention is to prepackage food so that the package can be placed in a microwave oven and automatic browning or crispening of the food article achieved by the time that the food has been fully heated. More specifically, an aim of our invention is to correlate the browning or crispening time with the time for dielectrically heating the prepackaged food item.

Another object of our invention is to provide a controlled browning heat over the particular area intended to be browned. More specifically, a uniform color can be produced or the color can taper from one shade to another.

Another object of the invention is to provide packaging material that is inexpensive and disposable. In this regard, it is within the purview of the invention to provide a package for frozen foods and the like which may be no more costly than conventional packaging materials now being employed.

A further object is to provide a quick, easy and convenient way to achieve a browning of certain foods inasmuch as the user need not first remove the food from the package. Thus, the user is able to place the entire package within the microwave oven and take out the entire package with the heated food therein after the heating has been consummated.

Yet another object of our invention is to provide an efficient way for browning and crispening foods in that the browning means is incorporated into the packaging material which is closely adjacent the food so that the package material enhances the heat generated from the microwave energy at the food surface. Consequently, the proximity of the energy converting means to the food contributes to the more accurate controlling of the browning action.

It is also an object to provide a wrapping material that has a low thermal mass, thereby avoiding virtually any stealing of heat from the food product itself and also obviating the need for any preheating, such as that required for browning utensils or dishes.

Another object is to obviate the degradation that occurs with respect to utensils or dishes used over and over to brown foods. Also, it is an aim of the invention to eliminate any need for cleaning, such as is necessary with re-usable vessels, since our wrapper is discarded once it has been removed from the food.

Still another object of the invention is to change a controlled portion of the total available microwave energy into heat for browning the surface of a food item, thereby permitting the high frequency microwave energy not converted to dielectrically heat the food item in the customary manner. In this way, by properly proportioning the amount of high frequency energy that is converted into heat energy at the surface of the food, the browning of a given item of food can be correlated with the dielectric heating of that item so that the desired degree of browning is achieved at substantially the same time that the dielectric cooking is completed.

Briefly, our invention discloses a means for the conversion of some of the microwave energy within a microwave oven into heat adjacent the outer surface of the food so that the food is browned or crispened at the same time that its interior is being dielectrically heated. A flexible dielectric substrate in the form of a sheet of plastic or paper or sheet of paperboard has a metallic coating thereon. The metallic coating is subdivided into a number of metallic islands or pads with nonmetallic gaps or strips therebetween, the gaps being provided by the underlying flexible dielectric substrate. The size of the islands can be varied, as can the gaps or nonmetallic strips therebetween. In this way, the degree of transparency of the composite wrapping material can be correlated with the particular type of prepackaged food to be heated.

BRIEF DESCRIPTION OF THE DRAWINGS

FIG. 5 is a top plan view showing islands of somewhat greater size than those appearing in FIG. 3, the islands being derived from a metal foil, with the view also depicting nonmetal gaps therebetween that are proportionately greater than the narrower gaps of FIG. 3, such gaps being obtained by cutting the foil with a sharp instrument such as a knife or the like;

DESCRIPTION OF THE PREFERRED EMBODIMENTS

Figure 1:
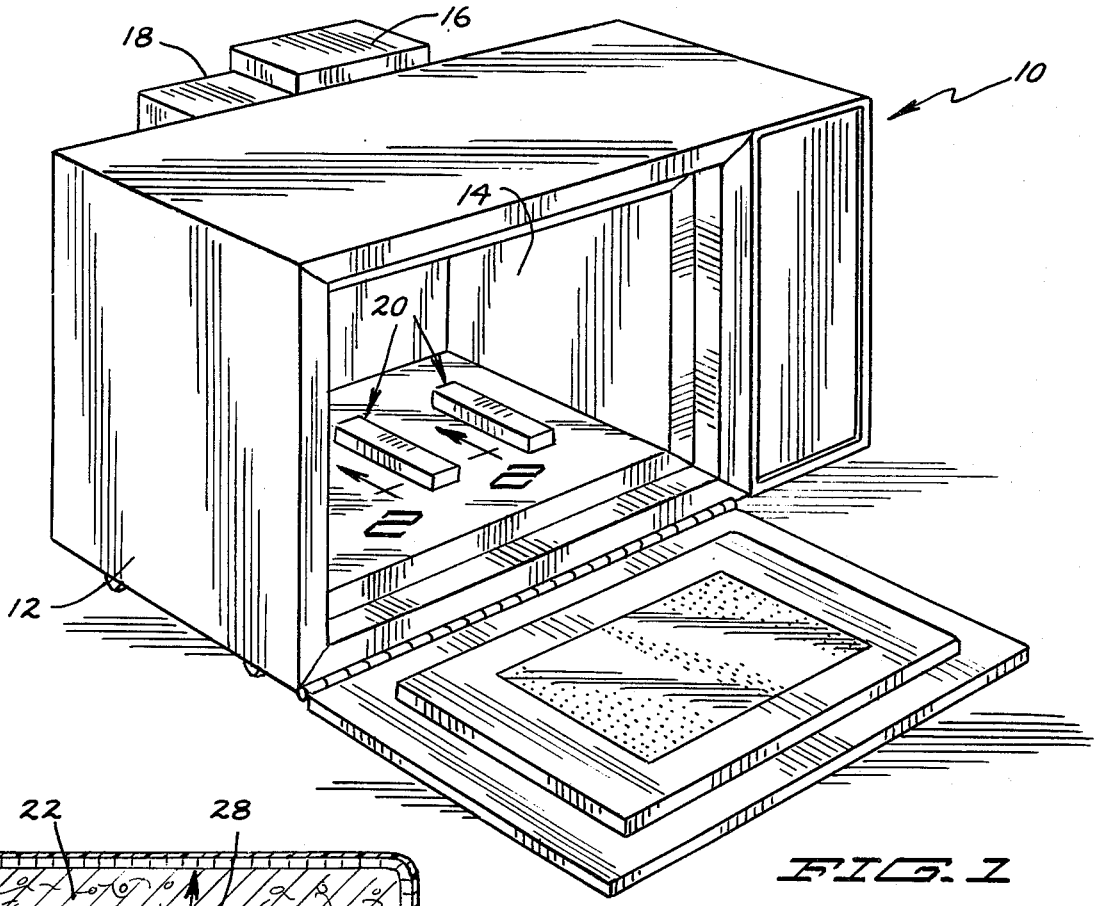
FIG. 1 is a perspective view of a microwave oven with the front open so as to expose to view two fish sticks prepackaged in accordance with the teachings of our invention.

Referring first to FIG. 1, a conventional microwave oven 10 has been illustrated. The oven 10 comprises a cabinet 12 containing a cooking cavity 14 in which food is placed in order to be heated by microwave energy. Although our invention is susceptible to use with various high frequencies capable of producing molecular friction, one officially approved microwave frequency is on the order of 2450 MHz. The microwave energy is introduced into the cavity 14 from a high frequency energy source 16, such as a magnetron, through a waveguide 18. The electromagnetic waves are radiated and reflected within the cavity 14 and such energy is absorbed by the food to be heated.

For the sake of illustration, in FIG. 1 two individual packages 20 have been shown. From FIG. 2, it can be appreciated that the article of food contained within each package constitutes a fish stick 22, fish sticks being typical of food products having an exterior that should be both browned and crispened in order to enhance the appearance and taste thereof. However, our invention will be useful with other foods, such as onion rings and potatoes, where browning and/or crispening proves desirable.

Figure 3:
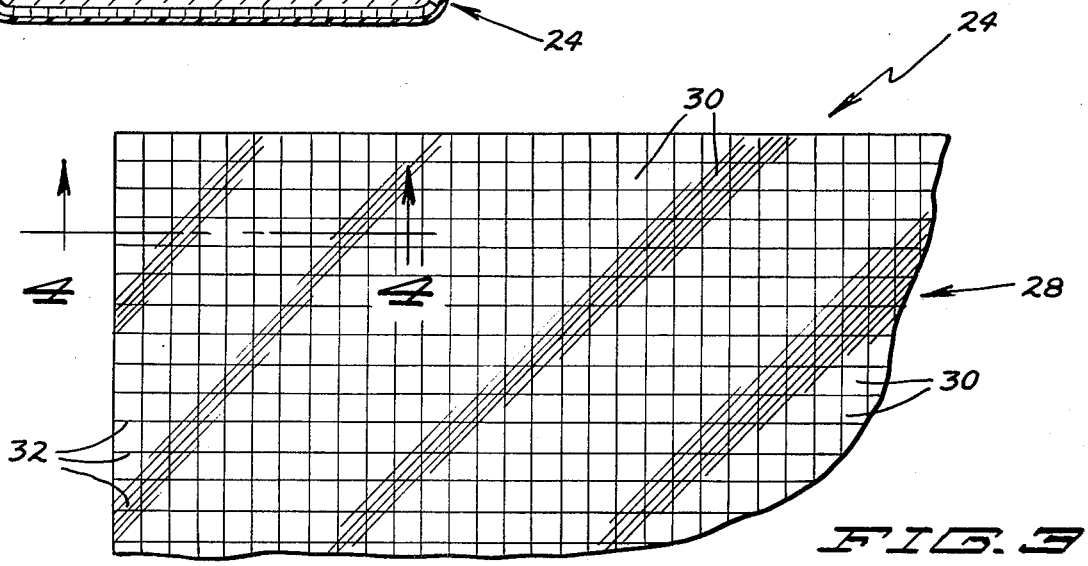
FIG. 3 is a fragmentary top plan view of one form of our wrapping material.
Figure 4:
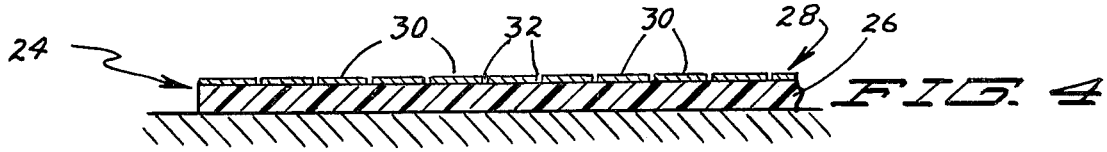
FIG. 4 is an enlarged sectional view taken in the direction of line 4—4 of FIG. 3 which shows the islands in the form of a thin film that has been initially evaporated onto a sheet of plastic and subdivided, such as by etching, masking and the like, to provide individual islands, the thickness of the islands being greatly exaggerated with respect to the underlying plastic sheet.

From FIGS. 3 and 4 it will be discerned that the wrapping material 24 used for the package 20 comprises a flexible dielectric substrate in the form of a plastic sheet 26, such as polyester film. A sheet 26 of this character is completely transparent to microwave energy and has been approved for use as a wrapping medium for frozen food items.

Figure 2:
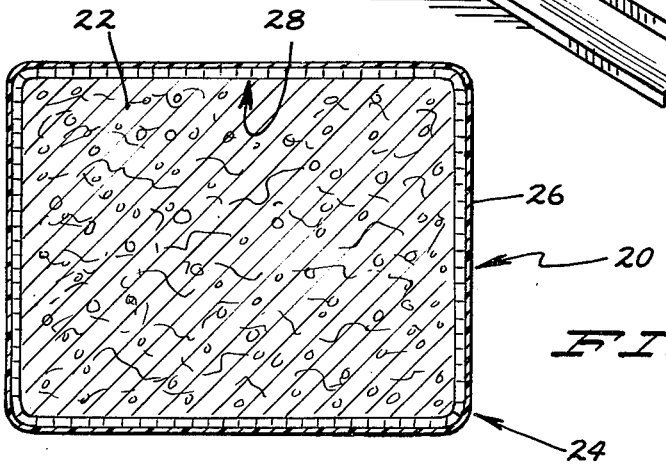
FIG. 2 is an enlarged sectional view taken in the direction of line 2—2 through one of the fish sticks of FIG. 1.

A metallic coating 28, its thickness being greatly exaggerated with respect to the thickness of the sheet 26 in both FIGS. 2 and 4, has been applied to one side of the plastic sheet 26, such as by vacuum evaporation. Other thin film metallizing techniques can be employed, though, such as by chemical or electrochemical depositing or cathode sputtering. Preferably, the coating 28 is aluminum, which is relatively inexpensive and which metal has been already used in the packaging of food products. Other materials, such as chromium, tin oxide or even silver or gold could be employed. While the coating 28 can vary in thickness, it is contemplated that it will be only on the order of one micron, actually considerably less. Metallic thin films of this very minute thickness, particularly those having a thickness of 0.1 micron or even less, will permit microwave energy to be transmitted therethrough to a pronounced degree, the energy not passing through being converted to heating energy. A coating having a resistivity within the range of from about 1 to 10 ohms per square is preferred although coatings having a resistivity of as high as about 300 ohms per square have been shown to convert the microwave energy into thermal heating energy.

The metallic coating 28 is subdivided into a number of metallic islands or pads 30 of 0.1 micron thickness or even less, by means of relatively narrow dielectric gaps or strips 32 which can be formed by means of a suitable screen or mask. As with the thickness of the metallic islands 30, the width of the gaps 32 in FIG. 4 has been exaggerated.

When the packages 20 are subjected to microwave energy, some of the energy passes through the thin film metallic islands 30 of each package and is radiated into the food article, which as already explained constitute the fish stick 22 in the exemplary instance. This energy dielectrically heats the interior of each fish stick 22, as microwaves normally do.

However, the presence of the metallic islands 30 modify the microwave field configuration, actually coupling more of the available microwave energy in the cavity into the fish sticks 22 than if only the fish sticks were present without our material 24 enwrapped thereabout. In other words, with our material 24 wrapped about the food in close proximity thereto, a greater amount of heating is obtained than without the material.

Some of the energy not transmitted through the wrapping material 24 is converted into thermal energy, which energy is utilized in the browning and/or crispening of the exterior surface of the fish sticks. In this regard, it will be recognized that the microwave field generates differences in potential between adjacent metallic islands 30 with electric currents passing back and forth through the plastic substrate 26, the resistance of the substrate causing heat to be generated. Also, the islands 30 not only act as plates of a capacitor with respect to each other but are believed to provide a capacitive action with the food 22. Irrespective of the theory involved, the practical result is that there is an enhanced heating which takes place innerjacent the wrapping material 24 which browns and/or crispens the outer surface of the fish sticks 22 (or whatever food is to be browned).

The desired degree of browning can be correlated with the amount of energy transmitted through the wrapping material 24. Thus, where fish sticks 22 normally take five or six minutes to cook, the degree of transparency or microwave transmissivity of the coating 28 can be such as to cause the desired degree of color to result by the time the fish sticks 22 are sufficiently cooked or heated for eating.

It is important to recognize that the wrapping material 24 is flexible and readily conforms to the shape of whatever food article is contained in the package 20. In this way, the metallic coating 28 is contiguous, or at least is closely adjacent to, the fish sticks 22 and the heat that develops is conducted directly into the surface of the food without having to be radiated through any intervening space.

Since the coating 28 is preferably extremely thin (on the order of one micron or less and preferably about 0.1 micron or even less than this), it has very little thermal mass. Therefore, when the microwave oven 10 is turned off or deenergized, there is virtually no residual heat in the wrapping material 24. Hence, the user can handle the package 20 very rapidly without being burned, which is not the case when more massive utensils or dishes are used. Of course, the food article becomes hot and some heat may be radiated back into the cavity 14 through the material 24, thereby necessitating some caution in picking up either package 20. Thus, when our invention is employed, the user could use the same degree of care that he or she would use when handling a conventional food package. The point to be appreciated, however, is that our package 20 does not result in a higher package temperature than conventional packages in which foods are heated without producing microwave browning.

Figure 5:
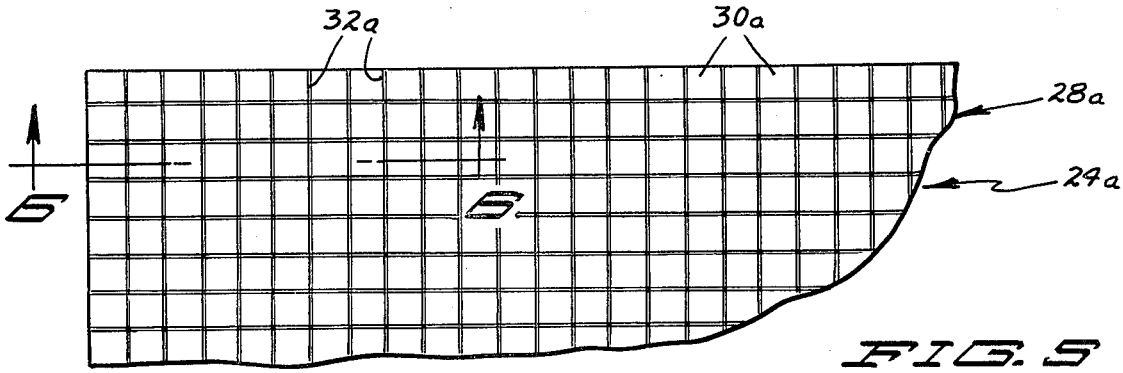
Figure 6:
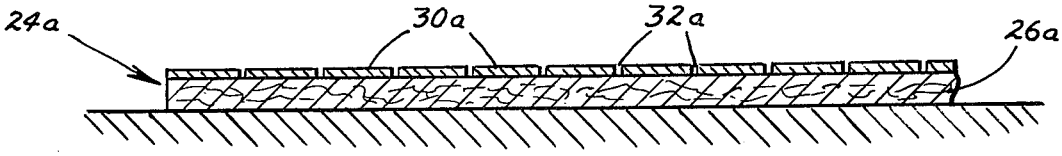
FIG. 6 is a sectional detail taken in the direction of line 6—6 of FIG. 5 for the purpose of showing the foil-derived metallic islands with respect to a paperboard substrate.

To illustrate the versatility of our invention, reference should now be made to FIGS. 5 and 6. In this instance, the wrapping material has been identified as 24*a*. The metallic coating 28*a* is composed of somewhat larger islands or pads 30*a* and the gaps or strips 32*a* therebetween are somewhat larger. Furthermore, the dielectric substrate in this instance constitutes a sheet 26*a* of paperboard instead of the plastic film constituting the sheet 26. Consequently, the additional thickness of the metallic islands or pads 30*a* is derived from using a metal foil. In other words, the metallic coating constitutes a metal foil, such as aluminum, which is adhered or laminated to one side of the paperboard sheet 26*a*.

In this situation, the metallic islands or pads 30*a*, owing to their thickness, are reflective and do not transmit microwave energy therethrough. Thus, instead of having a degree of transparency to microwave energy, they are opaque. The material 26*a* is partially transparent to microwave energy in that the nonmetallic gaps or strips 32*a* allow microwave energy to pass into the food product to cause dielectric heating of the fish sticks 22 or other article of food. The adjacent metallic islands 30*a*, by reason of their separation, act as the plates of a capacitor with the result that differences in electrical potential are generated therebetween. The potential differences cause a flow of current from one adjacent metallic island 30*a* to the next, the current passing through the dielectric substrate, more specifically the exposed areas of the paperboard sheet between the islands constituting the gaps or strips 32*a*. Owing to the voltage differences between the islands 30*a*, there is always a flow of electric current between islands through the paperboard 26*a*, and a concomitant generation of heat ($I^2R$) where the electrical resistance is supplied by the paperboard between adjacent islands 30*a*. Furthermore, the islands 30*a*, as do the islands 30, modify the microwave field configuration to provide even a more pronounced heating of the outer surface of the fish sticks 22. In other words, more of the available microwave energy in the cavity 14 is coupled into the food than without the material 20*a* with a greater concentration of heat occurring at the food's outer surface to brown and crispen the food item 22.

Figure 7:
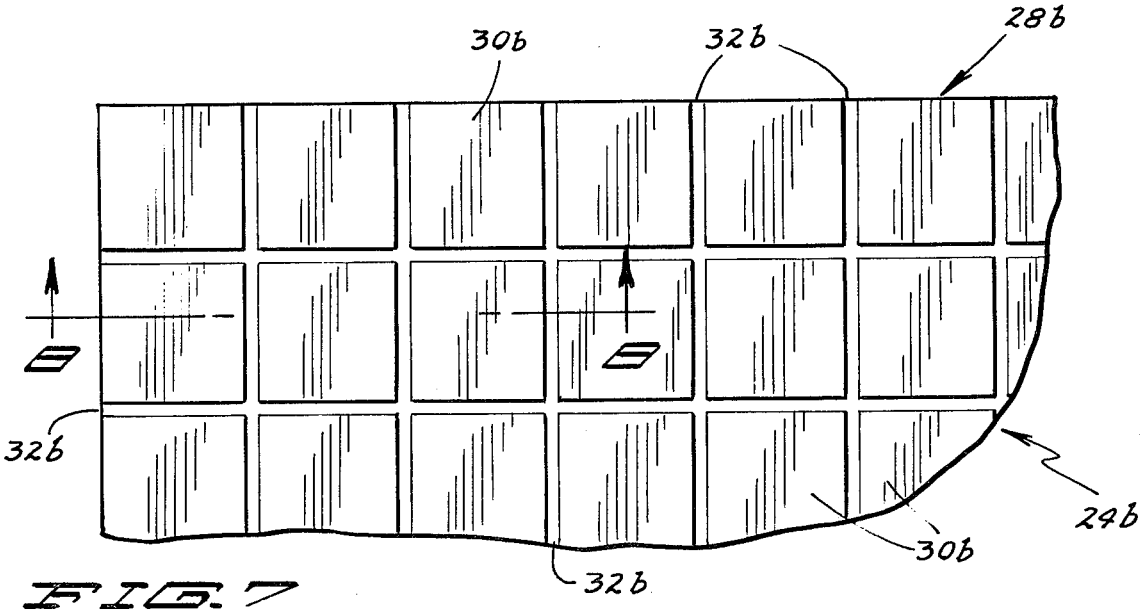
FIG. 7 is a plan view of wrapping material having still larger islands thereon with even wider dielectric strips or gaps therebetween.
Figure 8:
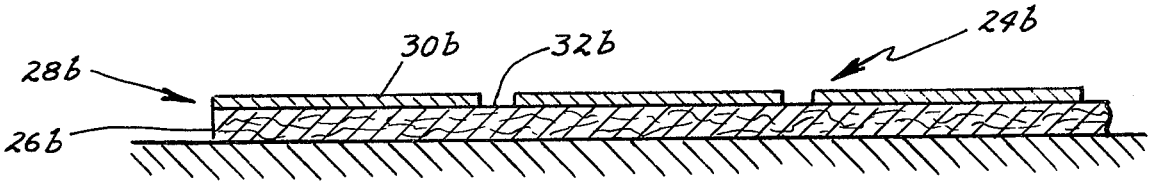
FIG. 8 is a sectional detail taken in the direction of line 8—8 of FIG. 7.

Turning now to FIGS. 7 and 8, the wrapping material 24*b* in these figures is very similar to the material 24*a* appearing in FIGS. 5 and 6. However, the rectangular metallic islands 30*b* constituting the coating 28*b* are larger than those of FIGS. 5 and 6. Also, the gap or strips 32*b* therebetween are somewhat wider. Here again, the metallic islands 30*b* are opaque and do not pass any electromagnetic energy into the food product.

Recapitulating, it can be pointed out that the rectangular metallic islands 30, 30*a* and 30*b* can vary from as little as about 1/32" on a side to up to about ¾" on a side. Preferably, such islands are on the order of about 1/16" to about ¼" on a side. In specific respects, the square metallic islands 30 of FIGS. 3 and 4 are on the order of 3/32" on a side, the islands 30*a* of FIGS. 5 and 6 on the order of ⅛" on a side, and the islands 30*b* of FIGS. 7 and 8 approximately ½" on a side. The gaps or strips 32, 32*a* and 32*b* can vary from 0.0001 to 0.0625 inch in width, the narrower gaps 32 being in FIGS. 3 and 4 and the larger width gaps 32*a*, 32*b* in FIGS. 5–8. As far as the thickness of the metallic islands is concerned, the islands 30 appearing in FIGS. 3 and 4 are on the order of one micron (preferably about 0.1 micron), whereas those of FIGS. 5–8 are on the order of 0.00035". Actually, the islands 30 are what might be termed semiconductive, having a resistivity of preferably about 1 to 10 ohms per square, and the islands 30*a*, 30*b* conductive, having a resistivity of only a very small fraction of an ohm.

It will be recalled that a plastic film, such as polyester plastic, can constitute the flexible substrate 26 in FIGS. 3 and 4. The thickness of the plastic film can preferably be approximately 0.001 inch. It is also within the purview of the invention that the metallic coating can be sandwiched or laminated between two layers of the plastic film and such materials have been shown to yield the thermal heating as described herein. The thickness of the paperboard 26*a*, 26*b* in FIGS. 5–8 on the other hand is preferably on the order of 1/32".

It is also to be appreciated that the flexible wrapping materials of the present invention can be supported exteriorly by more rigid dielectric materials such as paperboard and the like.

One of the features of the invention is that the degree of transparency can be selected so as to transmit most of the microwave energy therethrough, yet resistively and/or capacitively convert a percentage of the total microwave energy into energy for capacitively converting a percentage of the total microwave energy into energy for heating the outer surface of the article of food. If the food item requires only a short period of dielectric heating, then more microwave energy should usually be converted into thermal energy for heating the surface of the food item so that the rate of browning and/or crispening is accelerated and thus correlated with the overall period of time required to heat or cook the particular food item. On the other hand, if a relatively long dielectric period of heating is required for the food, then a lesser percentage of the total microwave energy to which the food package 20 is subjected should be converted into heat by our wrapping material 24, 24*a* or 24*b*. Consequently, the wrapping material 24, 24*a* or 24*b* in this latter case would be more transparent to the passage of the high frequency energy than in the accelerated browning situation mentioned in the first case. Not only is the microwave energy controlled as far as both dielectric heating and browning are concerned, but a more effective use is made of the available microwave energy in that more is coupled into the food product than without any material 24, *24a* or *24b* being present.

We claim:

1. A package containing an article of food, at least a portion thereof being capable of having either its color changed or crispened, said food article to be heated in a microwave oven, comprising a flexible dielectric material having at least a section thereof conforming generally to the shape of said portion of the food article, and individual electrically resistive islands carried by said dielectric material for converting some of the microwave oven energy to heat, said electrically resistive islands also conforming generally to the shape of said portion of food and residing in a proximal relation therewith, whereby the microwave energy converted to heat by said dielectric material and islands modifies the color or crispness of the food portion adjacent thereto.

2. A package in accordance with claim 1 in which said islands are partially transparent to microwave energy so that some of the microwave oven energy passes therethrough and some through said dielectric strips.

3. A package in accordance with claim 1 in which said islands are metallic and opaque to microwave energy so that some of the microwave oven energy is converted into heat by said islands and the dielectric material forming said strips, and some of the microwave energy passes through said dielectric strips.

4. A package in accordance with claim 1 in which said islands are rectangular with criss-crossing strips of said dielectric material residing therebetween.

5. A package in accordance with claim 1 in which said islands are metallic and are on the surface of said dielectric material nearer the portion of food.

6. A package in accordance with claim 1 in which said dielectric material is a sheet of plastic.

7. A package in accordance with claim 1 in which said dielectric material is a sheet of paperboard.

8. A package in accordance with claim 1 in which said islands are metallic and range from about 0.1 micron to 0.00035 inch thick.

9. A package in accordance with claim 8 in which said islands range from about 1/32 inch on a side to about 0.75 inch on a side and the strips therebetween range from 0.0001 to 0.0625 inch in width.

10. A package in accordance with claim 9 in which said islands range from about 1/16 inch on a side to about ¼ inch on a side.

11. A method of packaging an article of food to be heated in a microwave oven comprising the steps of conforming at least a section of a flexible sheet of dielectric material to the shape of at least a portion of the food article, said flexible sheet section having thereon electrically resistive islands for converting at least some of the microwave oven energy into heat for browning the surface of said food article which is adjacent thereto.

12. A method of heating an article of food in a microwave oven comprising the steps of confronting at least a surface portion of the food article to be heated with a section of flexible dielectric material, said section of material carrying thereon spaced metallic islands capable of converting some of the microwave oven energy into heat, retaining said section of flexible dielectric material and said metallic islands close to said surface portion of said food article, and subjecting said dielectric material, said metallic islands and said article of food to microwave energy for a period of time sufficient to modify the color of said surface portion.

13. Packaging material for regulating the amount of microwave cooking energy passing therethrough to an article of food when contained therein, said food to be heated in a microwave oven, said packaging material comprising a flexible dielectric substrate, and a plurality of electrically resistive islands on one side of said flexible substrate, said islands also being flexible so that at least a section of said substrate and the islands on said section can be flexed against food having a surface portion that is nonplanar.

14. Packaging material in accordance with claim 13 in which at least some of said islands are partially transparent to microwave energy, said islands having gaps of said dielectric substrate therebetween.

15. Packaging material in accordance with claim 14 in which said islands are generally rectangular.

16. Packaging material in accordance with claim 13 in which at least some of said islands are opaque to microwave energy, said opaque islands having strips of said dielectric substrate therebetween.

17. Packaging material in accordance with claim 1 in which the thickness of said islands is from approximately 0.1 micron to 0.00035 inch.

18. Packaging material in accordance with claim 17 in which said islands are from about 1/32 inch on a side to about ¾ inch on a side.

19. Packaging material in accordance with claim 18 in which said islands have dielectric strips extending therebetween, said strips having a width from 0.0001 to 0.0625 inch.

20. Packaging material in accordance with claim 19 in which said islands are from about 1/16 inch on a side to about ¼ inch on a side.

21. Packaging material in accordance with claim 13 in which said electrically resistive islands are metallic.

* * * * *

UNITED STATES PATENT AND TRADEMARK OFFICE

CERTIFICATE OF CORRECTION

PATENT NO. : 4,230,924

DATED : October 28, 1980

INVENTOR(S) : William A. Brastad & Nelson J. Beall

It is certified that error appears in the above-identified patent and that said Letters Patent are hereby corrected as shown below:

Column 5, line 13 - Remove " rapidly " and insert -- readily --.

Column 8, line 35, in Claim 17 - Remove "1" and insert -- 21 --.

Signed and Sealed this

*Thirteenth* Day of *January 1981*

[SEAL]

*Attest:*

SIDNEY A. DIAMOND

*Attesting Officer*

*Commissioner of Patents and Trademarks*